US011613394B2

(12) United States Patent
Bandholz

(10) Patent No.: US 11,613,394 B2
(45) Date of Patent: Mar. 28, 2023

(54) SYSTEMS AND METHODS FOR A LABEL WRAPPER

(71) Applicant: Brady Worldwide, Inc., Milwaukee, WI (US)

(72) Inventor: Brent Bandholz, Hubertus, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 16/839,869

(22) Filed: Apr. 3, 2020

(65) Prior Publication Data

US 2021/0309407 A1 Oct. 7, 2021

(51) Int. Cl.
*B65C 3/02* (2006.01)
*B65C 9/30* (2006.01)

(52) U.S. Cl.
CPC . *B65C 3/02* (2013.01); *B65C 9/30* (2013.01)

(58) Field of Classification Search
CPC ..... B65C 3/02; B65C 9/30
See application file for complete search history.

(56) References Cited

U.S. PATENT DOCUMENTS 4,648,233 A 3/1987 Holland
4,726,872 A 2/1988 Olsen
5,875,618 A * 3/1999 Sodies ..... B65B 27/105 53/586
5,954,918 A 9/1999 Belivakici
6,267,152 B1 * 7/2001 Doerr ..... B65C 3/02 140/93 A
6,875,304 B2 4/2005 Schanke et al.
7,178,572 B2 2/2007 Schanke et al.
2002/0084020 A1 7/2002 Scott et al.
2004/0206449 A1 10/2004 Schanke et al.
2004/0206459 A1 10/2004 Schanke et al.
2004/0211522 A1 10/2004 Fries et al.
2013/0019565 A1 1/2013 Witkiewicz

FOREIGN PATENT DOCUMENTS

DE 102008047251 A1 3/2010

OTHER PUBLICATIONS

PCT International Search Report and Written Opinion, PCT/US2021/025094, dated Jun. 22, 2021, 8 pages.

* cited by examiner

*Primary Examiner* — Philip C Tucker
*Assistant Examiner* — John Blades
(74) *Attorney, Agent, or Firm* — Quarles & Brady LLP

(57) ABSTRACT

Systems and methods include an assembly for a label wrapper to adhere a label to an elongated object, such as a wire. The assembly can include a roller having a roller axis and a compliant block with a notch. The notch can be parallel with the roller axis. The compliant block and the roller can be biased toward each other, and when the elongate object is received between the roller and the compliant block, a pressure can be applied to the elongate object whereby the compliant block at least in part conforms to the elongate object.

18 Claims, 6 Drawing Sheets

SYSTEMS AND METHODS FOR A LABEL WRAPPER

CROSS-REFERENCE TO RELATED APPLICATION

Not applicable.

FIELD OF INVENTION

This disclosure relates to label wrappers, and more particularly to a label wrapper with a block with a notch that can receive an elongated object.

BACKGROUND

Labels are often applied to elongate objects, such as wire, to provide information about the wire. One such approach is to apply a label by hand. This approach can prove difficult to do in an accurate, consistent, and timely manner. It can be difficult to consistently place the labels in such a way that the labels are square and aligned on the wire and also to properly and evenly adhere the label to the surface of the wire.

Accordingly, mechanical label applicators are available that assist in the application of preprinted labels to elongate objects such as wire. However, these applicators are often designed to be used with objects of relatively large diameter or size and, as the size of the elongate object becomes very small and/or if the object is very flexible (such as may be the case with slender fiber optic cables), then these applicator systems perform less robustly.

Therefore, a need exists for a device that can securely and uniformly apply a label to an elongate object with a relatively small cross-sectional periphery or diameter and/or that is flexible.

SUMMARY

Provided herein is a novel structure for a label wrapper assembly that addresses many of the aforementioned issues and provides an improved mode of application. Uniquely, such an improved label wrapper assembly may include a compliant block with a notch that receives the elongate object at wrapping. The compliant block can conform to a segment of the periphery of the elongate object, which may assist in providing even pressure across more area and permits for more robust and consistent application of a label to particularly slender objects that heretofore have been difficult to wrap using such label wrapper assemblies.

According to one aspect, a label wrapper assembly configured to adhere a label to an elongate object is provided. The label wrapper includes a roller having a roller axis and a compliant block with a notch extending parallel with the roller axis. The notch can be configured to receive the elongate object therein. The compliant block and the roller are biased toward each other and, when the elongate object is received between the roller and the compliant block, a pressure is applied to the elongate object whereby the compliant block at least in part conforms to the elongate object.

In some forms, the notch of the compliant block can have a substantially V-shaped profile providing a front surface and a rear surface. The front surface and the rear surface can be substantially perpendicular to each other. The front surface can have a greater surface area than that of the rear surface.

In some forms, the compliant block has a length and the notch can have a continuous profile extending the length of the compliant block.

In some forms, at least a section of the elongate object can be removably receivable within the notch, whereby the elongate object can have a diameter in the range of about 0.04 inch to about 0.25 inch.

In some forms, the roller of the label wrapper assembly can be a serrated roller. In some forms, the label wrapper assembly can include a tarp extending over the notch.

The label wrapper assembly can also include a bracket to which the compliant block is coupled. A set of end plates can be provided on either side of the bracket. The bracket can move relative to the set of end plates perpendicular to the roller axis and the roller can be coupled to the set of end plates. In some forms, the roller can be attached to an arm. The arm can rotate relative to the set of end plates.

In some forms, the compliant block and the roller can be biased toward each other by a set of torsion springs coupled to the set of end plates and operatively engaged with the bracket and the roller.

In some forms, the compliant block can be foam and the compliant block can further include a bottom surface facing the roller with the notch extending inward from the bottom surface.

In some forms, a cross-sectional area of a deformation zone of the compliant block can be reduced by at least 10% from a relaxed state when the pressure is applied to the elongate object. The cross-sectional area of the deformation zone can be in a plane perpendicular to the notch and the roller axis.

According to another aspect, a method of applying a mostly uniform pressure along an elongate object within the label wrapper assembly is provided. The method can include separating the compliant block and the roller; placing the elongate object between the compliant block and the roller and within the notch of the compliant block; and applying a pressure to the elongate object when the compliant block and the roller come back together; wherein the compliant block conforms to at least a portion of the elongate object within the notch.

In some forms, the elongate object can be cylindrical and the notch of the compliant block can conform to a portion of the circumference of the section of the elongate object received within the notch. The portion of the circumference can be in the range of about 90 degrees to about 180 degrees of the circumference.

As stated above and in some forms, the elongate object can have a diameter in the range of about 0.04 inch to about 0.25 inch when the method is employed.

In some forms of the method, the notch of the compliant block can have a substantially V-shaped profile providing a front surface and a rear surface. The front surface and the rear surface can be substantially perpendicular to each other. The front surface can have a greater surface area than that of the rear surface. In some forms, the compliant block can be polyurethane foam.

In some forms, the compliant block can be foam and the compliant block can further include a bottom surface facing the roller with the notch extending inward from the bottom surface.

In some forms, a cross-sectional area of a deformation zone of the compliant block can be reduced by at least 10% from a relaxed state when the pressure is applied to the elongate object. The cross-sectional area of the deformation zone can be in a plane perpendicular to the notch and the roller axis.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

BRIEF DESCRIPTION OF THE FIGURES

Advantages of embodiments of the present invention will be apparent from the following detailed description of the exemplary embodiments thereof, which description should be considered in conjunction with the accompanying drawings in which.

DETAILED DESCRIPTION

Figure 1:
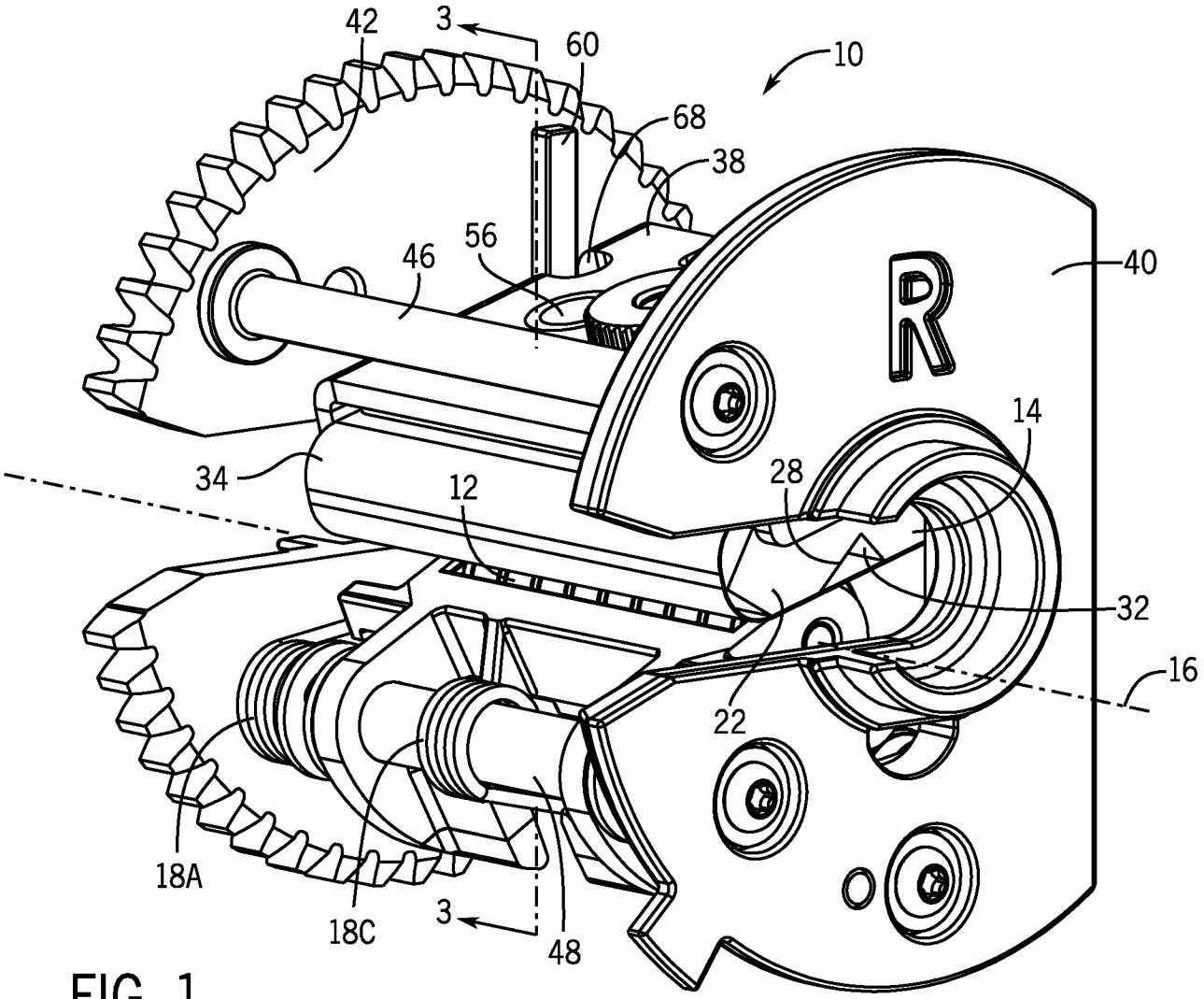
FIG. 1 is a front right side perspective view an exemplary embodiment of a label wrapper assembly.

Before any aspect of the present disclosure are explained in detail, it is to be understood that the present disclosure is not limited in its application to the details of construction and the arrangement of components set forth in the following description or illustrated in the following drawings. The present disclosure is capable of other configurations and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

Terms indicating relative position such as "above," "below," "upper," "lower," "rear," "front," and so forth are used for purposes of illustration only, unless otherwise noted and are made with reference to the orientation of the drawings. It should be understood that these terms are not generally meant to indicate a preferred orientation when such an orientation is not inherently or explicitly required.

Reference will be made throughout to applications of embodiments disclosed herein that adhere a label to a wire as one type of elongate object. Such references to a "wire" or "cable" is for purposes of illustration and are not intended to limit the claimed invention to such applications. Rather, any elongate object or objects may be used in conjunction with any label applicator described herein. For example, bundles of elongate objects are also contemplated as falling within the open-ended definition of elongate object.

Conventional approaches to label application can present challenges when an adhesive label is attempted to be applied onto an elongate object having a relatively small diameter (or, more generally, a small cross-sectional peripheral shape), such as a fiber optic cable or other small diameter wire with a diameter in a range of about 0.04 inch to about 0.25 inch. For example, when applying a label to such a small diameter cable, the label can stick to the label applicator as the label is pressed against the cable or the label may be misaligned thereby causing spiraling or wrinkling of the label or creating bubbles within the label. Further, it is difficult to evenly apply a "wetting" force or application pressure to the label as it is applied to the cable to ensure sufficient adhesion over the entire surface area of the cable.

Generally, the present disclosure provides a label wrapper assembly that can adhere a label to an elongate object—even when said elongate object is particularly small, flexible, and/or otherwise difficult to apply a label to. The disclosed label wrapper assembly can apply a more uniform wetting force to the elongate object during adhesion of a label thereto by use of a compliant block that at least partially conforms to the elongate object when a pressure is applied to the elongate object. In some embodiments, the pressure can be applied to the elongate object through a biasing member that biases a roller and the compliant block toward each other to captures the object within the label wrapper assembly for the rotation of the assembly and for the application of the label. In some embodiments, the compliant block can have a notch configured to receive the elongate object therealong during label application. In some embodiments, the notch can have a substantially V-shaped profile. However, in some embodiments, other configurations are possible. For example, certain features and combinations of features that are presented with respect to particular embodiments in the discussion above can be utilized in other embodiments and in other combinations, as appropriate.

This application discloses a number of improvements over and enhancements to other known label applicators. Such label applicators are disclosed, for example, in the inventor's U.S. Pat. Nos. 6,875,304 and 7,178,572, which are incorporated herein by this reference in their entirety for all purposes.

Figure 2:
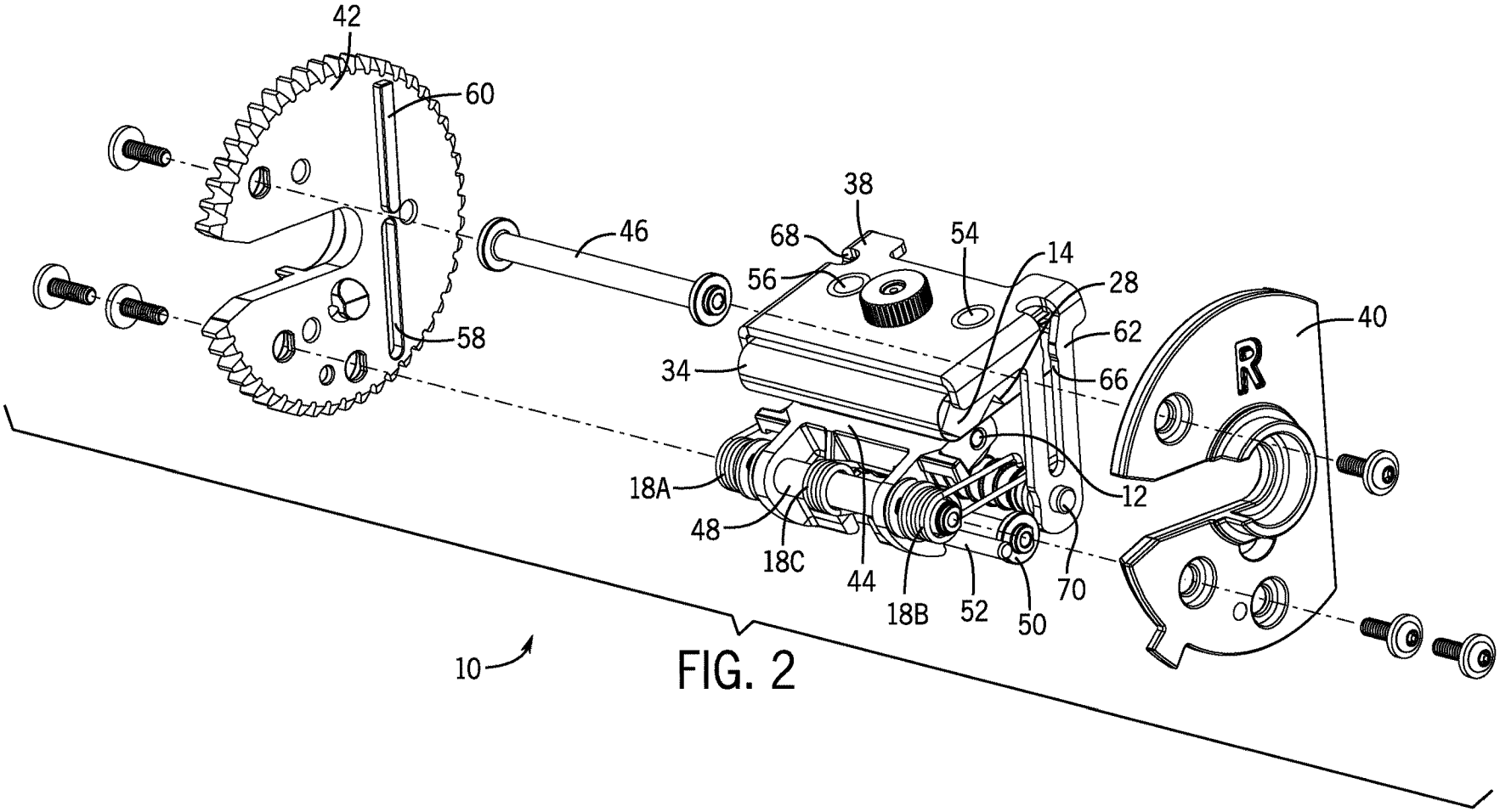
FIG. 2 is a partially exploded view of the label wrapper assembly of FIG. 1.
Figure 3:
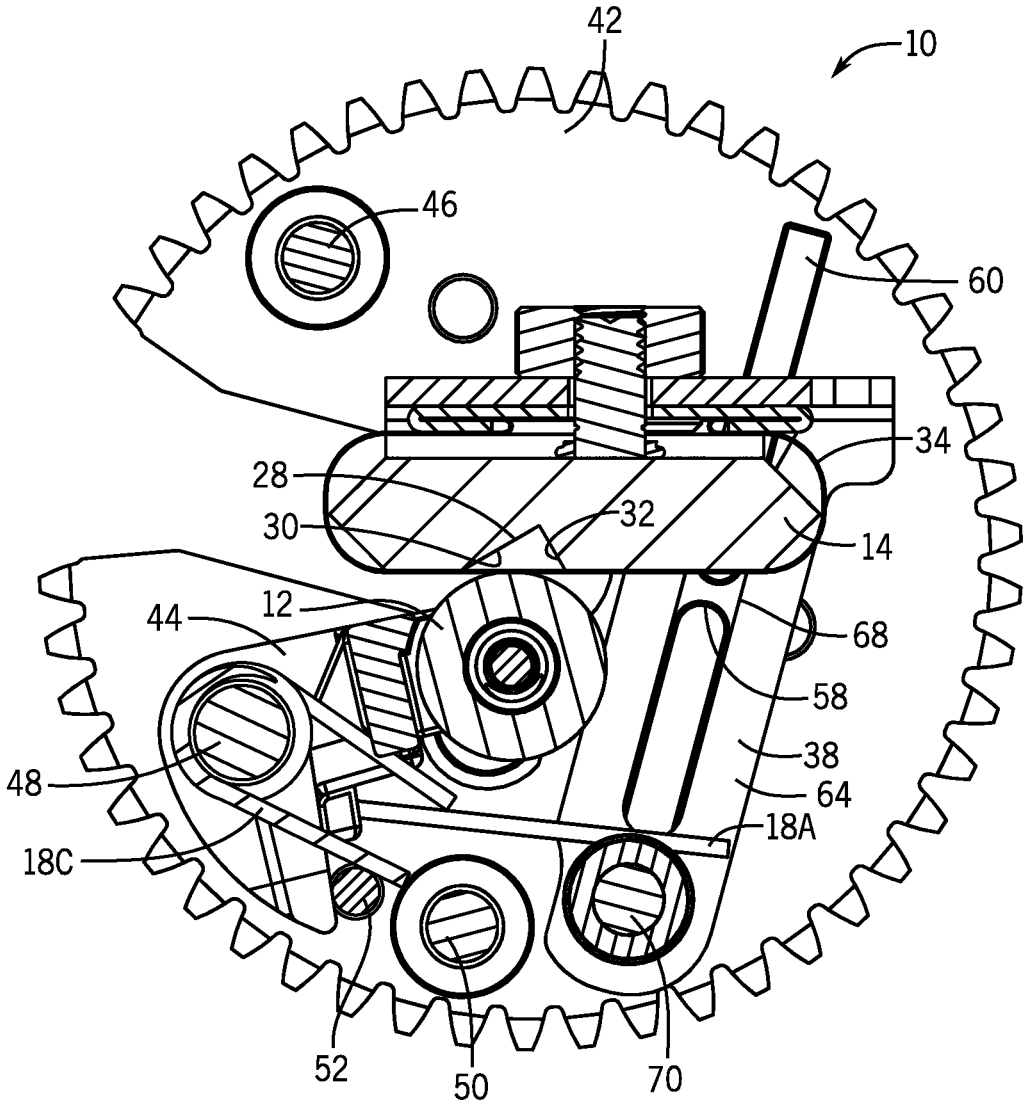
FIG. 3 is a cross-sectional side view of the label wrapper assembly shown in FIG. 1 taken along line 3-3 of FIG. 1.

Turning first to FIGS. 1-3, these figures illustrate a label wrapper assembly 10 containing such an improvement or enhancement as contemplated in part by this disclosure. It is noted that this is but one part of the larger assembly as can be found in the aforementioned patents by this inventor and the rest of the assembly is not shown in this application for conciseness; however, the pertinent parts to understand the improvement are illustrated. As illustrated, the label wrapper assembly 10 includes a roller 12, a compliant block 14, a bracket 38, a set of end plates 40, 42, and an arm 44. Generally, the set of end plates 40, 42 are coupled to each other and linearly spaced apart by a set of spacers or rods 46, 50. The bracket 38, which supports and is coupled to the compliant block 14, is slidably coupled to and between the set of end plates 40, 42. The roller 12 extends along a roller axis 16 and is coupled to the arm 44. The arm 44 is rotatably coupled to the rod 48. The roller 12 and the compliant block 14 may be biased toward each other. For example, in the illustrated embodiment, a set of torsion springs 18A, 18B, 18C are provided on the rod 48. The torsion springs 18A and 18B act between the set of end plates 40, 42 and the bracket 38 and the torsion spring 18C acts between the arm 44 and a structural member 52 coupled to and between the set of end plates 40, 42. The torsion springs 18A, 18B, 18C bias or force the roller 12 and the compliant block 14 toward each other and provide a pressure therebetween as well as on any elongate object, such as a wire, placed therebetween. While biasing springs are illustrated, other biasing mechanisms for doing the same are contemplated. The roller 12 can be serrated or have a plurality of ribs allowing the roller 12 to maintain contact with a label during the label application process and reduce the potential for adhesive build up.

Figure 6:
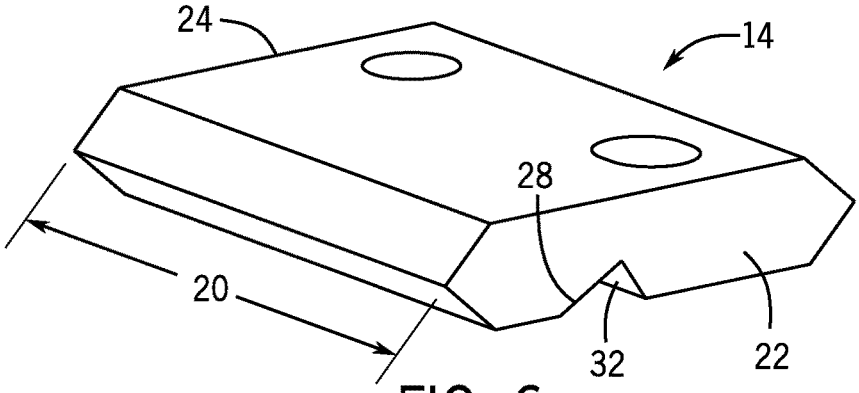
FIG. 6 is a top front right side perspective view of an example embodiment of a compliant block apart from the rest of the label wrapper assembly.
Figure 7:
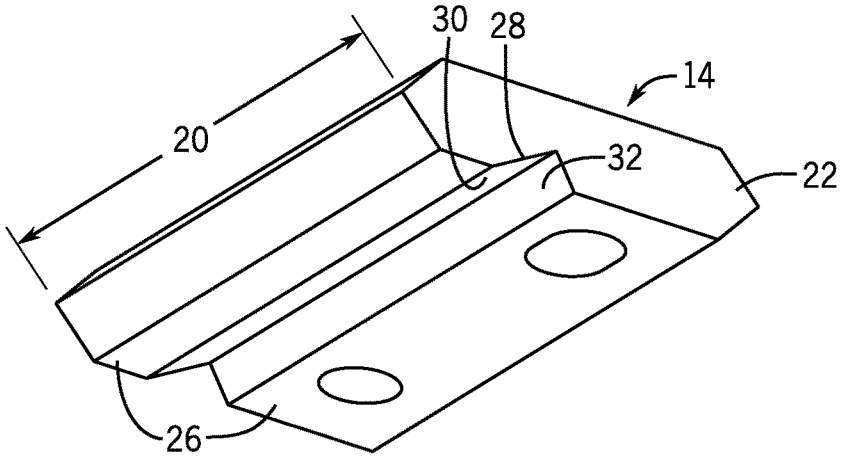
FIG. 7 is a bottom front right perspective view of the compliant block of FIG. 6.
Figure 8:
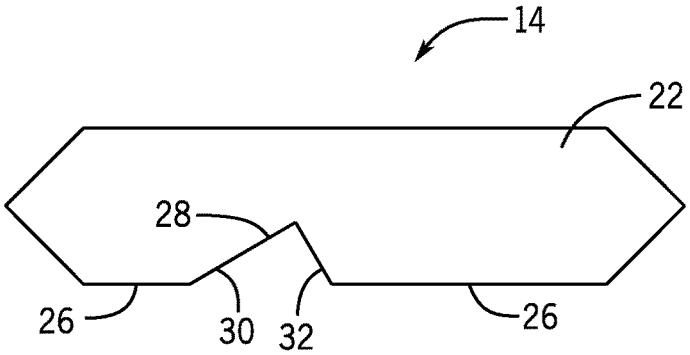
FIG. 8 is a side elevation view of the compliant block of FIG. 6.

Notably, the compliant block 14 (shown in greater detail in FIGS. 6-8) is preferably comprised of a conformable or deformable material. Examples of deformable materials include, but should not be limited to, open-cell and closed-cell foams and 3D printed lattice structures.

In the form illustrated, the compliant block 14 is formed from a polyurethane foam and is coupled to the bracket 38 with a set of anchors 54, 56 extending through the bracket 38 and at least partially into the compliant block 14. It is contemplated that the compliant block 14 can be removable from the rest of the label wrapper assembly 10. Therefore, the set of anchors 54, 56 can be removably receivable within the compliant block 14 to allow the compliant block 14 to be removed. The compliant block 14 can have a compliant block length 20 defined between two lateral ends 22, 24 and can have a bottom surface 26 facing the roller 12. As can be seen best in FIGS. 3, 4, and 6-8, the compliant block 14 has a notch 28 extending inwardly from the bottom surface 26 along the compliant block length 20 which runs parallel to the roller axis 16.

In one form, such as that illustrated in the figures, the notch 28 has a V-shape profile extending end-to-end along the compliant block length 20. The V-shape profile defines a front surface 30 and a rear surface 32 of the notch 28. The front surface 30 and the rear surface 32 can be substantially perpendicular to each other; however, acute and obtuse angles between the front surface 30 and the rear surface 32 are within the purview of the disclosure. In some embodiments, the front surface 30 can have a surface area that is greater than the surface area of the rear surface 32.

It is further contemplated that the notch 28 can be formed having other profiles than a V-shaped profile. For example, a semi-circular or other arcuate or semi-arcuate profile may be employed or a semi-polygonal shape. It is also contemplated that the notch 28 can be formed to have a continuous or a discontinuous profile along all or part of the compliant block length 20 from lateral end 22 to lateral end 24. For example, some protrusions or recesses may be present along the notch 28 forming a sinusoidal-like or tooth-like variance.

The label wrapper assembly 10 can also include a tarp 34 that extends across the notch 28 and can further extend over the bottom surface 26 of the compliant block 14. The tarp 34 can further be coupled to the bracket 38. Such a tarp 34, if present, can be used to reduce wear on the compliant block 14, ease rotation around an elongate object 36 during label application as discussed further below; and prevent the buildup of adhesive.

As discussed above, the bracket 38 is slidably coupled to and between the set of end plates 40, 42 and can be movable relative to the pair of end plates 40, 42 and to the roller axis 16. Each of the set of end plates 40, 42 has an end plate slot 58 and an elongate protrusion 60 (the end plate slot and the elongate protrusion for the end plate 40 are hidden from view in the figures, but can be seen on plate 42). The bracket 38 has a set of bracket slots 66, 68 extending along a set of bracket legs 62, 64 (FIGS. 2 and 3) that receive and translate along the elongate protrusions 60. An auxiliary roller 70 extends between and through the bracket legs 62, 64, whereby the portions extending through are received within the end plate slots 58 to translate therealong. As illustrated, this movement is a linear translation, but could be different in nature based on the particular guidance mechanism. The movement of the bracket 38 thereby allows movement of the compliant block 14 relative to the roller 12 and relative to the end plates 40, 42. This movement of the bracket 38 and compliant block 14 relative to the roller 12 allows for separating the roller 12 and the compliant block 14 to receive and remove the elongate object 36 from the label wrapper assembly 10. Because the roller 12 and the compliant block 14 are biased toward each other, the sliding relationship can also allow for a more uniformly applied pressure between the roller 12 and the compliant block 14 by the torsion spring 18 or other biasing element.

Figure 4:
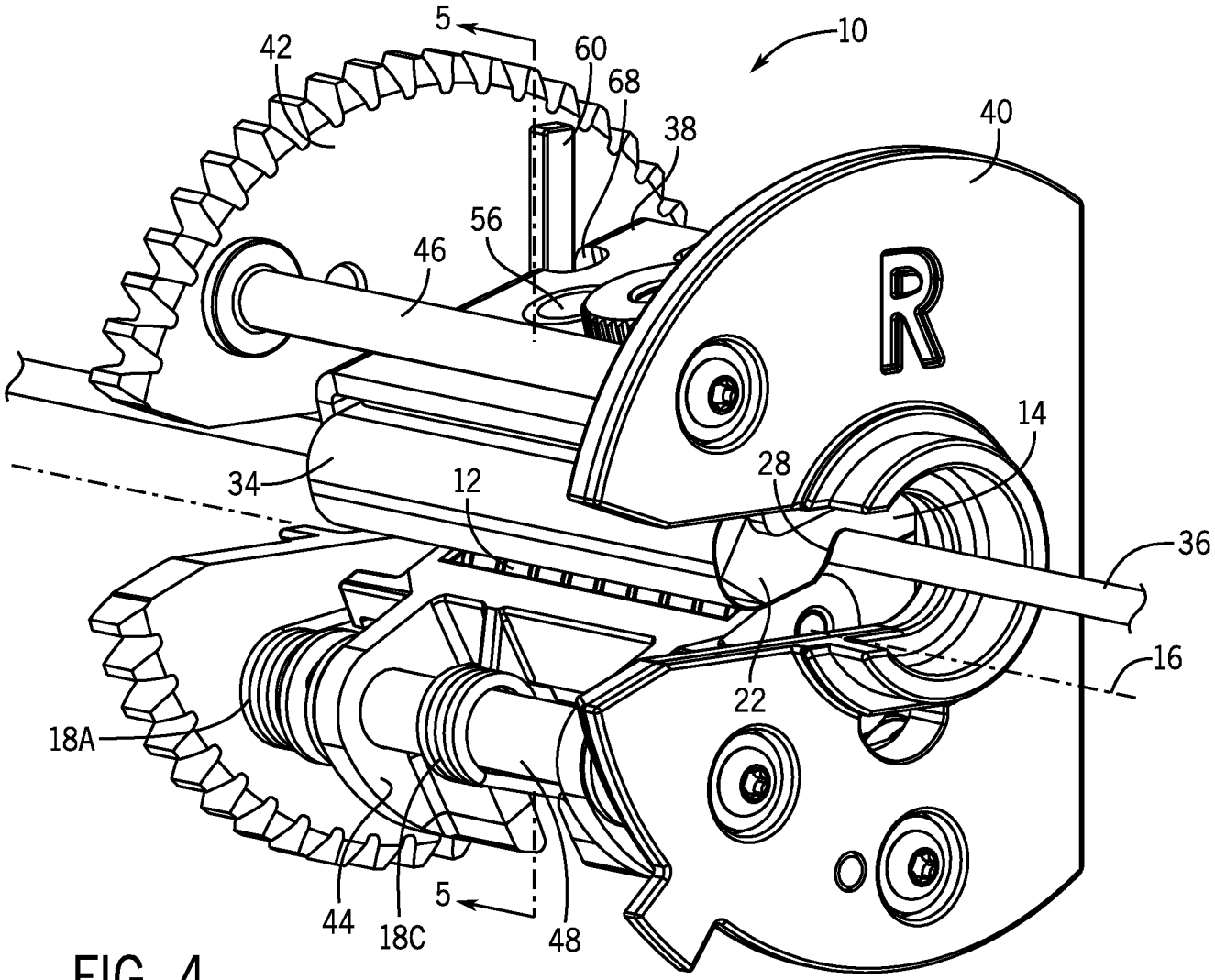
FIG. 4 is a front right side perspective view of the label wrapper assembly of FIG. 1 further with an elongate object received therein.
Figure 5:
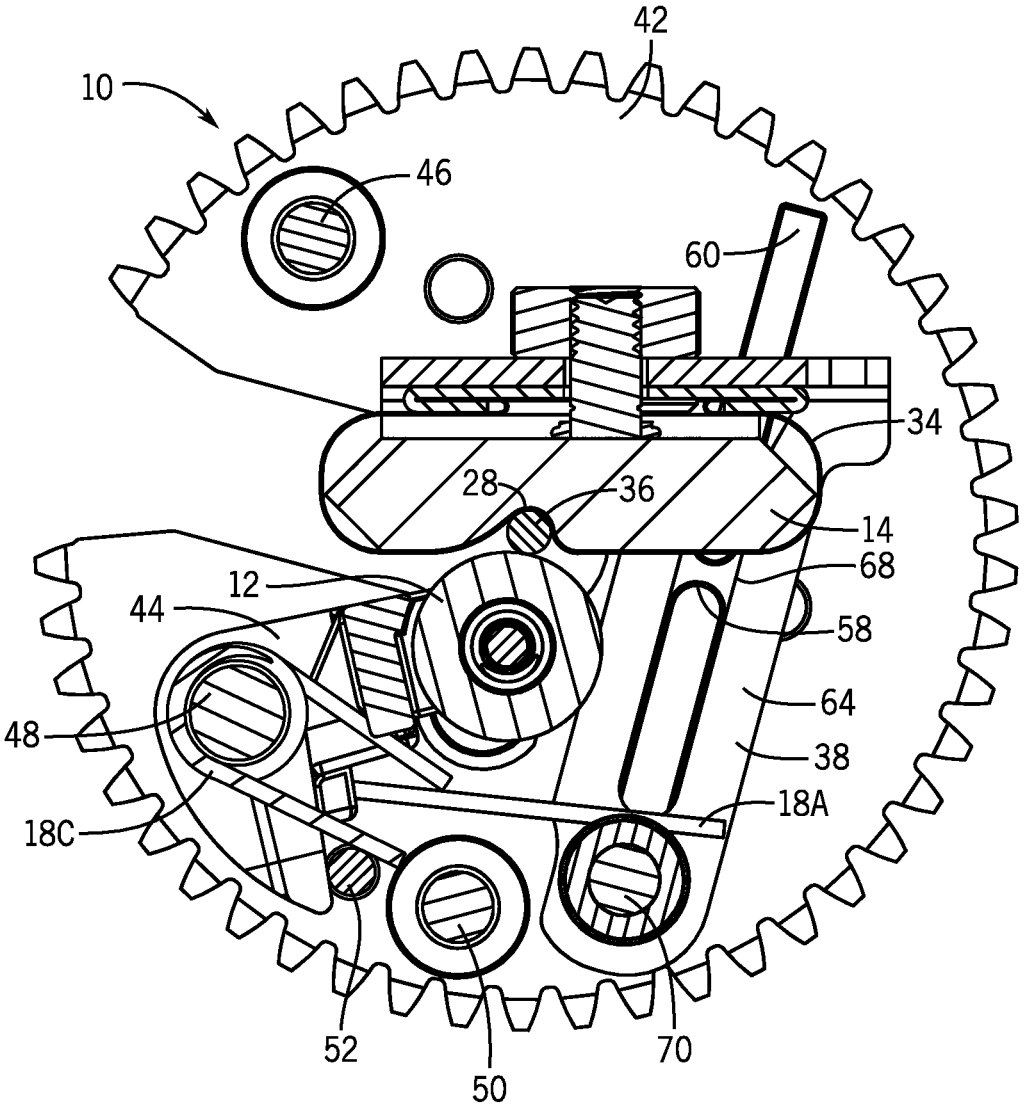
FIG. 5 is a cross-sectional side view of the label wrapper assembly shown in FIG. 3 taken along line 5-5 of FIG. 4.

FIGS. 4 and 5 show an elongate object 36 extending through the label wrapper assembly 10. The elongate object 36 can be a generally cylindrical object, including a singular cable or wire or a bundle of cables or wires. Of course, wires and cables are inherently flexible and so some limited deviation from true cylindrical would be expected in the elongate object 36.

The elongate object 36 can be received within the notch 28 and between the roller 12 and the compliant block 14. The pressure provided between the roller 12 and the compliant block 14 forces the compliant block 14 to conform around at least a portion of the elongate object 36 substantially along the compliant block length 20. Generally, the material comprising the compliant block 14 is configured to be more deformable than the elongate object 36 and will concede space to the elongate object 36 by deforming when the elongate object 36 is received between the compliant block 14 and the roller 12. The materials contemplated for the compliant block 14 have an elastic memory and can maintain the elastic memory after at least 1000 cycles, wherein one cycle includes compression and relaxation of the compliant block 14.

In some embodiments, the compliant block 14 is configured to deform as it transitions between a relaxed state (FIG. 4) and a compressed state (FIG. 5) in the region surrounding the notch 28, including the front surface 30 and the rear surface 32 of the notch 28. For example, the elongate object 36 may have a circular profile and, when received between the compliant block 14 and the roller 12, the compliant block 14 deforms inward at the notch 28 due to contact with the elongate object 36. The compliant block 14 can deform non-linearly from the area of contact with the elongate object 36 to the surfaces of the compliant block 14 opposite the notch 28 as the force imparted by the elongate object 36 is distributed throughout the compliant block 14, with the highest amount of deformation nearest or in the region of the elongate object 14. Some portion or all of the compliant block 14 can experience some level of deformation. The portion of the compliant block 14 that experiences some level of deformation defines a deformation zone. It is contemplated that in some embodiments the compliant block 14 can experience a reduction in cross-sectional area of at least 10% between a to-be-deformed area of the relaxed state and the deformation zone of the compressed state, wherein the cross-sectional area of the compliant block 14 is viewed in a plane perpendicular to the notch 28 and the roller axis 16. For compliant blocks comprising a lattice structure, it should be understood that the cross-sectional area includes both the lattice framework and the negative space within the lattice framework when comparing area adjustments or differences.

In some embodiments the percentage amount of deformation can be based on linear measurements. For example, a relaxed front distance can be defined as the distance along a relaxed front line extending perpendicular from a front surface point at the center of the front surface 30 to an outer surface of the compliant block 14 opposite the front surface 30 and a relaxed rear distance can be defined as the distance along a relaxed rear line extending perpendicular from a rear surface point at the center of the rear surface 32 to an outer surface of the compliant block 14 opposite the rear surface 32 when the compliant block 14 is in the relaxed state. Further, a compressed front distance can be defined as the distance along a compressed front line collinear with the relaxed front line and extending from the front surface point to the outer surface area and a compressed rear distance can be defined as the distance along a compressed rear line collinear with the relaxed rear line and extending from the rear surface point to the outer surface area when the compliant block 14 is in the compressed state. Wherein the percentage reduction between sum of the relaxed front and rear distances and the sum of the compressed front and rear distances can be at least 10%.

Elongate objects having a smaller diameter are generally difficult to secure without damaging during the label application process. The compliant block 14 aids in securing elongate objects having a diameter in the range of about 0.04 inch to about 0.25 inch, and also more particularly within the range of about 0.04 inch to about 0.10 inch.

Once the elongate object 36 is received within the notch 28 and between the roller 12 and the compliant block 14, the label wrapper assembly 10 can rotate around the elongate object 36 during label application. The notch 28 in the compliant block 14 can reduce the potential for the elongate object 36 to slip out from between the roller 12 and compliant block 14 or the tarp 34 as the label wrapper assembly 10 rotates about the elongate object 36 during label application because the elongate object 36 is captured substantially, if not entirely, along the length 20 of the compliant block 14 from the lateral end 22 to the lateral end 24. Further, to some degree, the elongate object 36 can be nested or seated in the notch 28 to help pre-set the position of the elongate object 36 over the axial span. In this way, the conforming of the compliant block 14 around the elongate object 36 can also provide a pre-wrap of a label around the elongate object 36. For example, when the label is inserted between the elongate object 36 and the compliant block 14 the label is partially curved around the elongate object 36 prior to activating the label wrapper assembly 10 to rotate around the elongate object 36 to apply the label. The increase in initial surface area contact can improve overall adherence of the label to the elongate object 36.

Moreover, the conforming characteristic of the compliant block 14 allows for greater contact with the elongate object 36 and any irregularities around the periphery of the elongate object 36 or along the portion of the elongate object 36 received within and along the notch 28. So, in particular, the presence of a pre-fabricated notch 28 can help guide the initial seating of the elongate object 36 in the label wrapper assembly 10 and can apply a more even application force (i.e., a "wetting" force), in a way that even a compliant block without a notch may not be able to do quite as well because of the lack of a pre-formed notch and the greater variance in the pressure over the contacting surface area where there is not even a rough notch profile (pre-compression) that roughly corresponds to the object.

A method of retaining an elongate object within the label wrapper assembly 10 is also contemplated. The method can include separating the compliant block 14 and the roller 12; placing the elongate object 36 between the compliant block 14 and the roller 12 and within the notch 28 of the compliant block 14; and applying a pressure to the elongate object 36 when the compliant block 14 and the roller 12 come back together. When the compliant block 14 and the roller 12 come back together, the compliant block 14 can conform to at least a portion of the elongate object 36 within the notch 28. For example, the notch 28 of the compliant block 14 can conform to a portion of the circumference of the cylindrical elongate object 36 in the range of about 90 degrees to about 180 degrees of the circumference. Then, upon relative rotation of the illustrated part of the wrapper assembly 10 about the elongate object 36, the application pressure is rotationally varied to cause a length of the wrapper to be drawn against and wrapped around the elongate object 36, forming good interfacial contact along the way.

Thus, systems and methods including a label wrapper assembly configured to adhere a label to an elongate object are disclosed herein. The label wrapper assembly can be used to efficiently and repeatability attach a label to an elongate object, for example a wire. The label wrapper assembly can retain an elongate object and uniformly press a label against the elongate object to minimize bubbles and does not allow the label to axially shift along the elongate object during the label application process wrapped.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A label wrapper assembly configured to adhere a label to an elongate object, the label wrapper assembly comprising:

a roller having a roller axis; and a compliant block with a notch extending parallel with the roller axis, the compliant block being formed from a deformable material and the notch configured to receive the elongate object therein, the notch having a substantially V-shaped profile providing a front surface and a rear surface;

wherein the front surface and the rear surface are substantially perpendicular to each other and the front surface has a greater surface area than that of the rear surface; and wherein the compliant block and the roller are biased toward each other and, when the elongate object is received between the roller and the compliant block, a pressure is applied to the elongate object whereby the compliant block at least in part conforms to the elongate object.

2. The label wrapper assembly of claim 1, wherein the compliant block has a length and the notch has a continuous profile extending the length of the compliant block.

3. The label wrapper assembly of claim 1, wherein at least a section of the elongate object is removably receivable within the notch and the elongate object has a diameter in the range of about 0.04 inch to about 0.25 inch.

4. The label wrapper assembly of claim 1, wherein the roller is a serrated roller.

5. The label wrapper assembly of claim 1 further comprising a tarp extending over the notch.

6. The label wrapper assembly of claim 1 further comprising a bracket to which the compliant block is coupled.

7. The label wrapper assembly of claim 6 further comprising a set of end plates provided on either side of the bracket;

whereby the bracket can move relative to the set of end plates perpendicular to the roller axis; and whereby the roller is coupled to the set of end plates.

8. The label wrapper assembly of claim 7, wherein the roller is attached to an arm, the arm can rotate relative to the set of end plates.

9. The label wrapper assembly of claim 8, wherein the compliant block and the roller are biased toward each other by a set of torsion springs coupled to the set of end plates and operatively engaged with the bracket and the roller.

10. The label wrapper assembly of claim 1, wherein the compliant block is foam and the compliant block further comprises a bottom surface facing the roller and the notch extends inward from the bottom surface.

11. The label wrapper assembly of claim 1, wherein a cross-sectional area of a deformation zone of the compliant block is reduced by at least 10% from a relaxed state when the pressure is applied to the elongate object, the cross-sectional area of the deformation zone being in a plane perpendicular to the notch and the roller axis.

12. A method of applying a mostly uniform pressure along an elongate object within the label wrapper assembly of claim 1, the method comprising:

separating the compliant block and the roller;

placing the elongate object between the compliant block and the roller and within the notch of the compliant block; and applying a pressure to the elongate object when the compliant block and the roller come back together;

wherein the compliant block conforms to at least a portion of the elongate object within the notch.

13. The method of claim 12, wherein the elongate object is cylindrical and the notch of the compliant block conforms to a portion of the circumference of the section of the elongate object received within the notch.

14. The method of claim 13, wherein the portion of the circumference is in the range of about 90 degrees to about 180 degrees of the circumference.

15. The method of claim 12, wherein the elongate object has a diameter in the range of about 0.04 inch to about 0.25 inch.

16. The method of claim 12, wherein the compliant block is polyurethane foam.

17. The method of claim 12, wherein the compliant block is foam and the compliant block further comprises a bottom surface facing the roller and the notch extends inward from the bottom surface.

18. The method of claim 12, wherein a cross-sectional area of a deformation zone of the compliant block is reduced by at least 10% from a relaxed state when the pressure is applied to the elongate object, the cross-sectional area of the deformation zone being in a plane perpendicular to the notch and the roller axis.

* * * * *